US009818555B1

(12) United States Patent
Terry et al.

(10) Patent No.: US 9,818,555 B1
(45) **Date of Patent: *Nov. 14, 2017**

(54) ENCAPSULATING PROTECTIVE COVER FOR A SWITCH

(71) Applicant: The Boeing Company, Chicago, IL (US)

(72) Inventors: Joshua Kye Terry, Lynnwood, WA (US); Bobby Joe Marsh, Lake Stevens, WA (US); Michael Anthony Fleming, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/672,867

(22) Filed: Aug. 9, 2017

Related U.S. Application Data

(63) Continuation of application No. 14/849,133, filed on Sep. 9, 2015, now Pat. No. 9,761,386.

(51) Int. Cl.

| | |
|---|---|
| ***H01H 3/20*** | (2006.01) |
| ***H01H 9/20*** | (2006.01) |
| ***H01H 9/28*** | (2006.01) |
| ***H01H 11/00*** | (2006.01) |
| *H01H 9/02* | (2006.01) |
| *H01H 23/14* | (2006.01) |
| *H01H 23/04* | (2006.01) |

(52) U.S. Cl.
CPC ..... *H01H 9/20* (2013.01); *H01H 9/287* (2013.01); *H01H 11/00* (2013.01); *H01H 23/04* (2013.01); *H01H 23/146* (2013.01); *H01H 2009/0292* (2013.01)

(58) Field of Classification Search
CPC ..... H01R 13/514; H01R 13/4223; H01R 13/4365; H01H 9/02; H01H 9/0228; H01H 9/0242; H01H 9/0264; H01H 9/0271; H01H 9/04; H01H 9/041; H01H 9/042; H01H 9/045; H01H 9/20; H01H 9/22; H01H 9/226; H01H 9/24; H01H 9/26; H01H 9/262; H01H 9/281; H01H 9/282; H01H 9/283; H01H 9/287; H01H 11/00; H01H 23/04; H01H 23/146; H01H 2009/0292
USPC ..... 200/38, 241, 242, 43.21; 174/50, 66, 67, 174/53; 439/752, 595
See application file for complete search history.

(56) References Cited

U.S. PATENT DOCUMENTS

| | | | |
|---|---|---|---|
| 3,246,103 | A | 4/1966 | Bellek |
| 5,779,083 | A | 7/1998 | Bordwell |
| 6,028,268 | A | 2/2000 | Stark et al. |
| 6,462,278 | B1 | 10/2002 | Vrame |

(Continued)

*Primary Examiner* — Anthony R. Jimenez
(74) *Attorney, Agent, or Firm* — McDonnell Boehnen Hulbert & Berghoff LLP

(57) ABSTRACT

Methods and devices related to preventing accidental operation of a switch are disclosed. An example device includes a main body, and a latch element rotatably connected to the main body and is configured to move relative to the main body between an unlatched position and a latched position. In the latched position, the main body and the latch element encapsulate the switch. Also, in the latched position, the main body and the latch element form a cavity configured to accommodate wiring to the switch. Further, the main body is configured with a cutout to reveal a status of the switch. The switch has Lock Out Tag Out (LOTO) index pin compatibility.

20 Claims, 5 Drawing Sheets

(56) References Cited

U.S. PATENT DOCUMENTS

| | | | | |
|---|---|---|---|---|
| 6,519,208 | B2 | 2/2003 | DeVries | |
| 6,649,838 | B1 * | 11/2003 | Lopez, Sr. | H02G 3/14 174/67 |
| 7,262,376 | B2 | 8/2007 | Brojanac et al. | |
| 7,410,372 | B2 * | 8/2008 | Johnson | H02G 3/088 174/66 |
| 9,222,285 | B1 | 12/2015 | Ilislamloo et al. | |
| 2013/0200046 | A1 | 8/2013 | Demandt et al. | |
| 2015/0299988 | A1 | 10/2015 | Abe et al. | |
| 2017/0069440 | A1 | 3/2017 | Terry et al. | |

* cited by examiner

ENCAPSULATING PROTECTIVE COVER FOR A SWITCH

CROSS REFERENCE TO RELATED APPLICATION

The present application is a continuation of U.S. patent application Ser. No. 14/849,133, filed on Sep. 9, 2015, the entire contents of which are herein incorporated by reference.

FIELD

The present disclosure relates generally to an encapsulating protective cover for a switch to prevent accidental operation of the switch.

BACKGROUND

Machines and manufacturing or production environments may include switches that control various operations. A switch may be maintained in a particular position, e.g., an unactivated position, until an event occurs that requires activation of (e.g., turning-on) the switch. However, in some cases, the switch could be inadvertently activated, thus starting an operation unintentionally, or deactivate, stopping an operation unintentionally. It is thus desirable to prevent accidental operation of such a switch.

To prevent accidental operation of a switch during manufacturing, wiring to the switch may be removed or disconnected. In this manner, even if the switch is accidently activated (e.g., turned on), an electric circuit controlled by the switch would not become operational because current would not be discharged to the circuit. Wires can be reconnected later to make the switch operational again. However, disconnecting the wires and reconnecting them later may cause problems.

Disconnecting and reconnecting wires may cause damage to connector pins in the switch. Further, when the wires are reconnected, testing (e.g., electrostatic discharge testing) may be required to ensure operational safety of the switch and comply with regulations. Functional testing may also be required for the wires. A certified electrician may be required to reconnect the wires when they are disconnected. It is thus desirable to prevent accidental operation of the switch without disconnecting and reconnecting wiring to the switch.

SUMMARY

The present disclosure describes embodiments that relate to methods, devices, and systems associated with an encapsulating protective cover for a switch. In one aspect, the present disclosure describes a device for preventing accidental operation of a switch. The device includes a main body and a latch element rotatably connected to the main body and is configured to move relative to the main body between an unlatched position and a latched position. In the latched position, the main body and the latch element encapsulate the switch. Also, in the latched position, the main body and the latch element form a cavity configured to accommodate wiring to the switch. Further, the main body is configured with a cutout to reveal a status of the switch.

In another aspect, the present disclosure describes a method for preventing accidental operation of a switch. The method includes rotating a latch element of an encapsulation device relative to a main body of the encapsulation device to an unlatched position. The latch element is pivotally mounted to the main body and is configured to rotate relative to the main body between the unlatched position and a latched position. The method also includes positioning the main body and the latch element such that the switch is disposed between the main body and the latch element. The method further includes rotating the latch element to the latched position to encapsulate the switch. The method also includes locking the latch element in the latched position. The main body and the latch element form a cavity configured to accommodate wiring to the switch, and the main body is configured with a cutout to reveal a status of the switch.

In still another aspect, the present disclosure describes a device for preventing accidental operation of a switch. The device includes an upper element and a lower element rotatably connected to the upper element by way of a pivot bolt. The lower element is configured to pivot about the pivot bolt relative to the upper element between an open position and a closed position. In the closed position, the upper element and the lower element encapsulate the switch in an off position. Also, in the closed position, the upper element and the lower element form a cavity configured to accommodate wiring to the switch. Further, in the closed position, the upper element and the lower element form a cutout to reveal a status of the switch.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
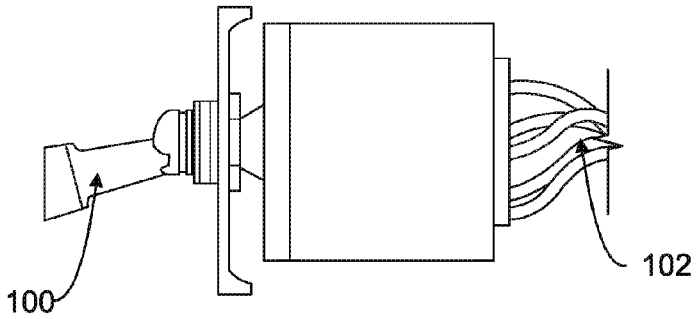
FIG. 1 illustrates an example switch, in accordance with an example implementation.

The following detailed description describes various features and functions of the disclosed systems and methods with reference to the accompanying figures. The illustrative system and method embodiments described herein are not meant to be limiting. It may be readily understood that certain aspects of the disclosed systems and methods can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

I. OVERVIEW

In examples, a machine, apparatus, vehicle, or a production environment may be equipped with a switch that is maintained in a particular state (e.g., off position) until an event occurs that requires changing the state of the switch (e.g., turning the switch on). As a particular example for illustration, an aircraft may be equipped with an escape ramp or evacuation slide used to evacuate the aircraft in emergencies. Such an evacuation slide may, for example, may be controlled by a switch. Such a switch may be installed in the aircraft in an unactivated state (e.g., in an off position). In the case of an emergency, the switch may be activated to deploy the evacuation slide.

As mentioned herein, the switch is installed in the aircraft in an unactivated state and should be maintained in such a state until an emergency situation occurs. Further, during the manufacturing of the aircraft or a door assembly of the aircraft, this switch should be maintained in an inactive or undeployed state. Accidentally activating such a switch during manufacturing may cause unintended deployment of the evacuation slide.

In another example related to an aircraft environment, some aircraft seats are equipped with airbags for protection during emergency situations. The airbags may be activated or made operational by activating a switch. Similar to the evacuation slide switch, the switch that makes the airbag operational should also be maintained in an undeployed state during manufacturing of the aircraft. Inadvertent activation of the switch may cause the airbag to be accidently deployed.

In still another example, many machines and production environments are equipped with switches that control safety operations. The switches are maintained in a particular position, e.g., an inactivated position, until an event occurs that requires activation of (e.g., turning-on) the switches. However, during, for example, manufacturing the machines including these switches, the switches could be inadvertently deployed.

These examples are for illustration only, and are not intended to be limiting. There are other examples of machinery and environments that include switches that should be maintained in an inactivated state until an event occurs. It is thus desirable to prevent accidental operation of such switches.

II. EXAMPLE DEVICES

FIG. 1 illustrates an example toggle switch 100, in accordance with an example implementation. The switch 100 is shown in an off position, and electric wires 102 are connected to the switch 100. When the switch 100 is turned on (e.g., pushed upward in FIG. 1), an electric circuit is closed and the wires carry electric signals that activate a particular operation (e.g., deploys an evacuation slide of an aircraft).

The switch 100 is configured to be maintained in an unactivated position until a particular event occurs (e.g., an emergency). However, left unprotected, the switch 100 may be accidently activated prior to occurrence of such an event. As an example, an operator working near the switch 100 in a manufacturing environment may inadvertently bump into the switch 100, thus causing the switch 100 to turn on. Such accidental activation may cause undesired circumstances. To prevent such unintentional activation, the switch 100 is protected by an encapsulating protective cover as described next.

Figure 2A:
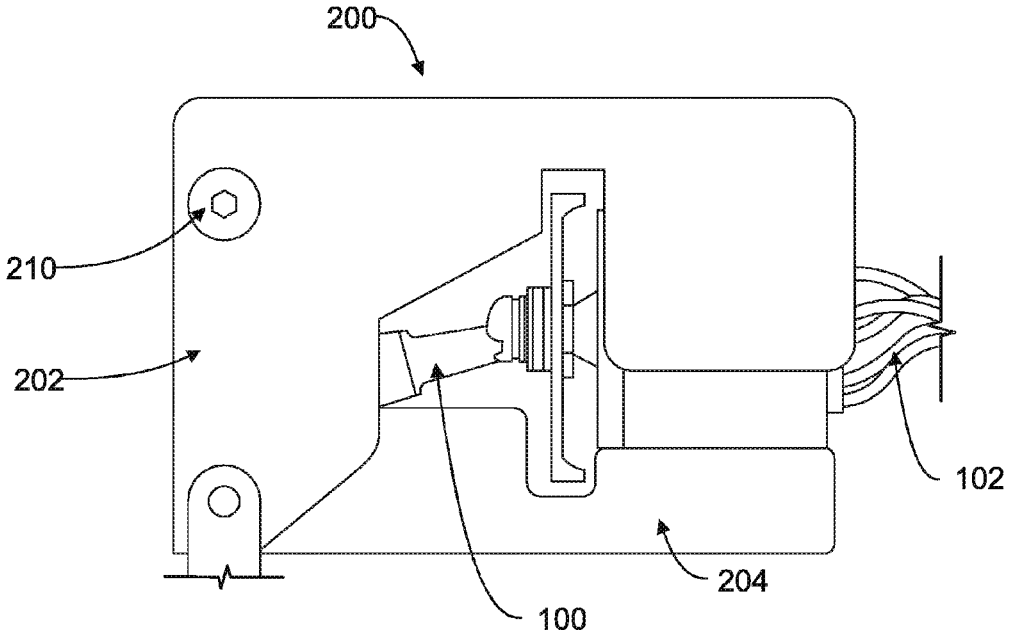
FIG. 2A illustrates an example protective cover, in accordance with an example implementation.
Figure 2B:
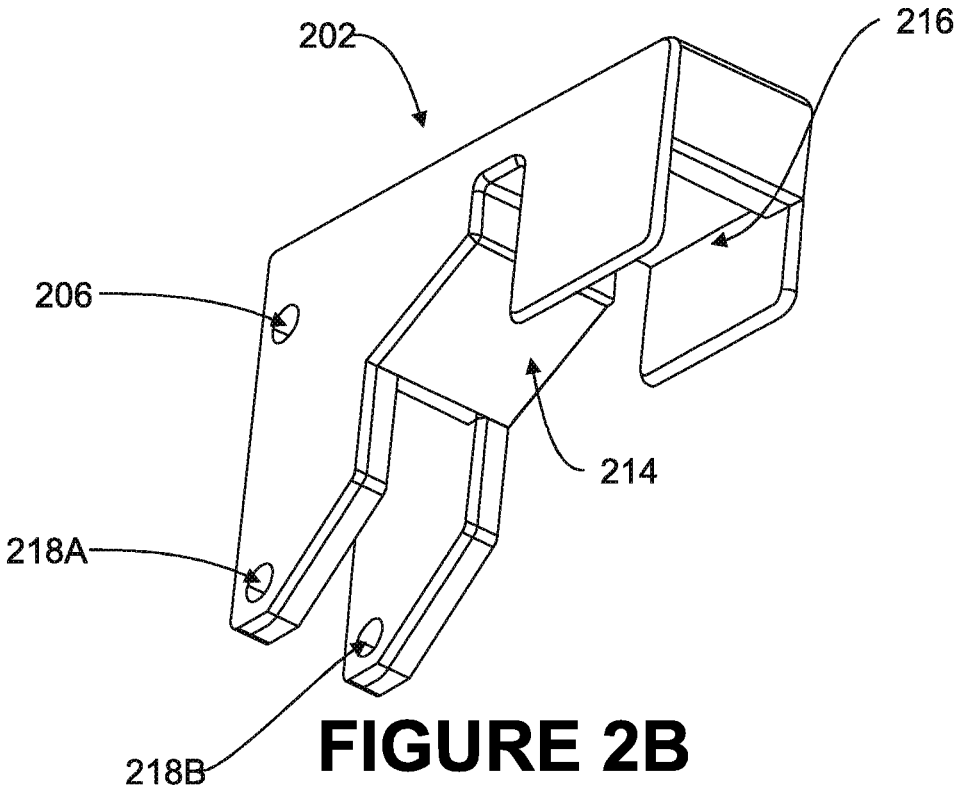
FIG. 2B illustrates a main body of the protective cover, in accordance with an example implementation.
Figure 2C:
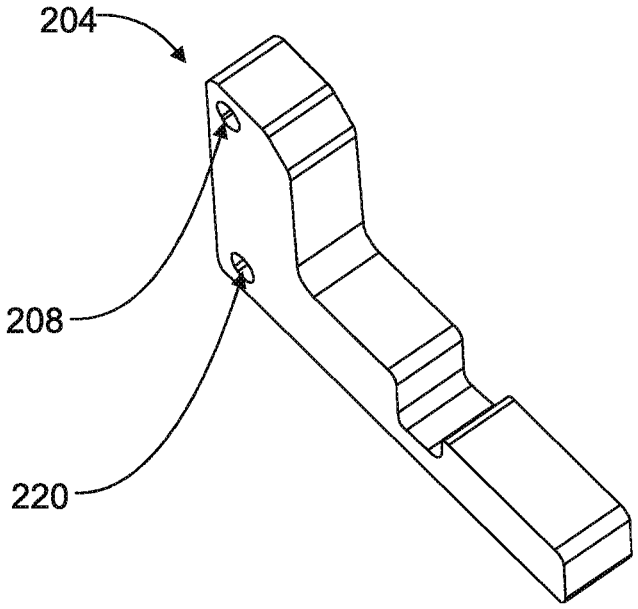
FIG. 2C illustrates a latch element of the protective cover, in accordance with an example implementation.

FIG. 2A illustrates an example protective cover 200, in accordance with an example implementation. FIG. 2B illustrates a main body 202 of the protective cover 200, in accordance with an example implementation. FIG. 2C illustrates a latch element 204 of the protective cover 200, in accordance with an example implementation.

The main body 202 has a hole 206, and a corresponding hole on the other side of the main body 202 (not shown in FIG. 2B). The latch element 204 has a through-hole 208. The latch element 204 is configured to be assembled to the main body 202 such that the hole 206 is aligned with the through-hole 208.

A pivot bolt 210 is disposed and retained through the holes 206 and 208 such that the latch element 204 is rotatably connected to the main body 202 by way of the pivot bolt 210. In this manner, the latch element 204 is configured to pivot about the pivot bolt 210 relative to the main body 202 between an unlatched position (open position) and a latched position (closed position). The protective cover 200 is shown in FIG. 2A while the latch element 204 is in the latched/closed position.

Figure 2D:
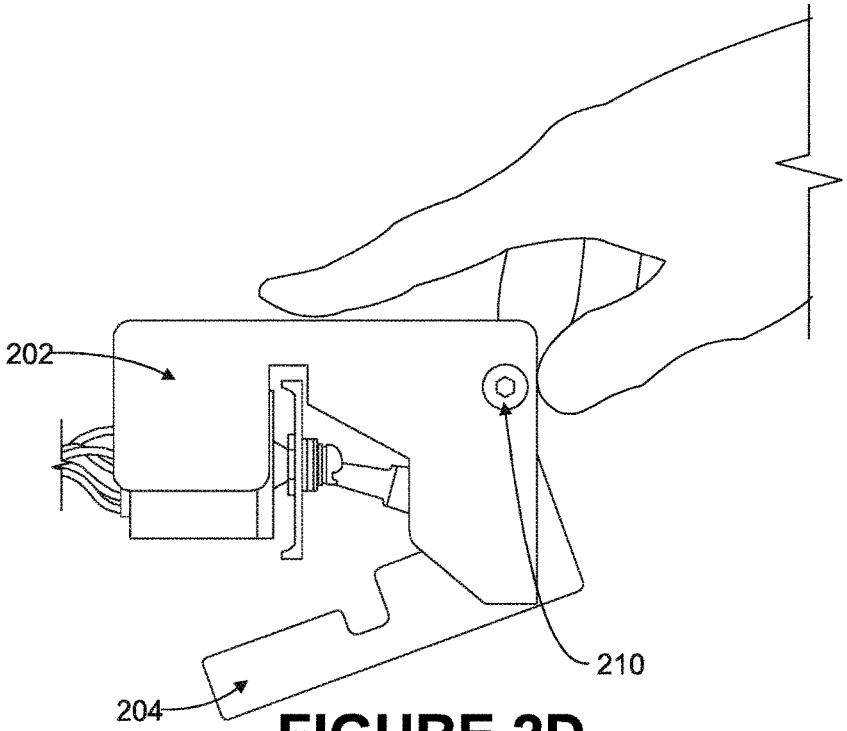
FIG. 2D illustrates the protective cover while the latch element is in an unlatched/open position, in accordance with an example implementation.

FIG. 2D illustrates the protective cover 200 while the latch element 204 is in an unlatched/open position, in accordance with an example implementation. To encapsulate the switch 100, the latch element is rotated to an unlatched position as shown in FIG. 2D. The main body 202 may be positioned on top of the switch 100 and pressed down. Thereafter, the latch element 204 may be rotated around the pivot bolt 210, such that the switch 100 is disposed substantially between the main body 202 and the latch element 204, to the latched or closed position as shown in FIG. 2E.

Figure 2E:
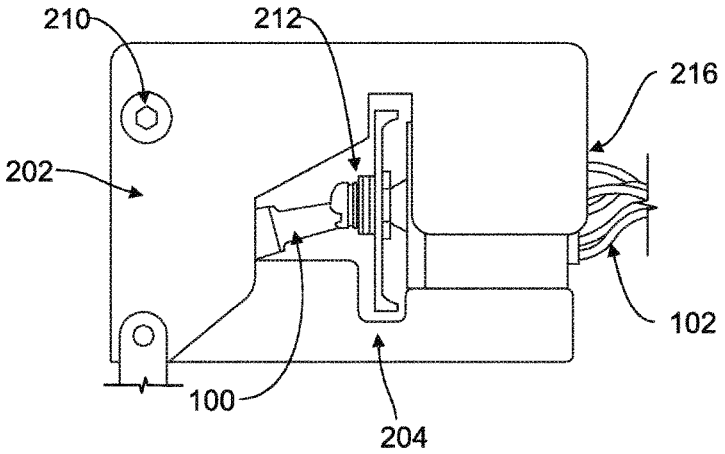
FIG. 2E illustrates the protective cover encapsulating the switch, in accordance with an example implementation.

FIG. 2E illustrates the protective cover 200 encapsulating the switch 100, in accordance with an example implementation. As shown in FIG. 2E, the latch element 204 is rotated to a latched or closed position relative to the main body 202 to encapsulate the switch 100. In an encapsulated position shown in FIG. 2E, the switch 100 is protected from accidental operation.

The main body 202 has a cutout 212 to reveal or indicate a status of the switch 100. An operator may look through the cutout 212 to determine whether the switch 100 is in an "off" state or an "on" state. The cutout 212 has a size that is sufficiently small to preclude entry of an object that could cause accidental operation of the switch 100. For example, the cutout 212 is sufficiently small that it would prevent an operator from accidently inserting a finger or a tool that would activate the switch 100. Further, the main body 202 has a slanted portion 214 shown in FIG. 2B that physically precludes the switch 100 from moving to an activated state even if an object accidently bumps into the switch 100.

Further, when the latch element 204 rotates to the latched/closed position shown in FIG. 2E, a cavity 216 is formed. The cavity 216 is configured to accommodate the wiring 102 to the switch 100. This way, there is no need to disconnect the wiring 102 to install the protective cover 200 around the switch 100. In examples, the cavity 216 may be in either the main body 202 or the latch element 204. In the implementation shown in FIGS. 2A-2D, the cavity 216 is formed in the main body 202. However, in other examples, the cavity 216 may be formed in the latch element 204, or partially in the main body 202 and partially in the latch element 204.

Several techniques could be implemented to secure the latch element 204 in the latched or closed position shown in FIG. 2E so as to maintain the switch 100 encapsulated within the protective cover 200. In an example implementation, a torsional spring (not shown in the Figures) could be mounted around the pivot bolt 210. In this manner, the torsional spring may be configured to exert a biasing force against the latch element 204 to bias the latch element 204 to the latched position shown in FIG. 2E. Particularly, a force may be exerted (e.g., by an operator) against the torsional spring to cause the latch element 204 to rotate to the unlatched/open position in FIG. 2D. After placing the protective cover 200 on top of the switch 100, the latch element 204 could be released and the torsional spring would exert a force to restore the latch element 204 to the latched/closed position.

Other techniques could be used to retain the latch element 204 in the latched position. Referring back to FIGS. 2B and 2C, the main body 202 may have holes 218A and 218B, and the latch element 204 may have a through-hole 220. When the latch element 204 is in the latched position, the through-hole 220 is aligned with the holes 218A and 218B to form an aperture. A locking pin could be inserted into the through-hole 220 and the holes 218A and 218B to lock the latch element 204 in the latched position as illustrated in FIG. 2F.

Figure 2F:
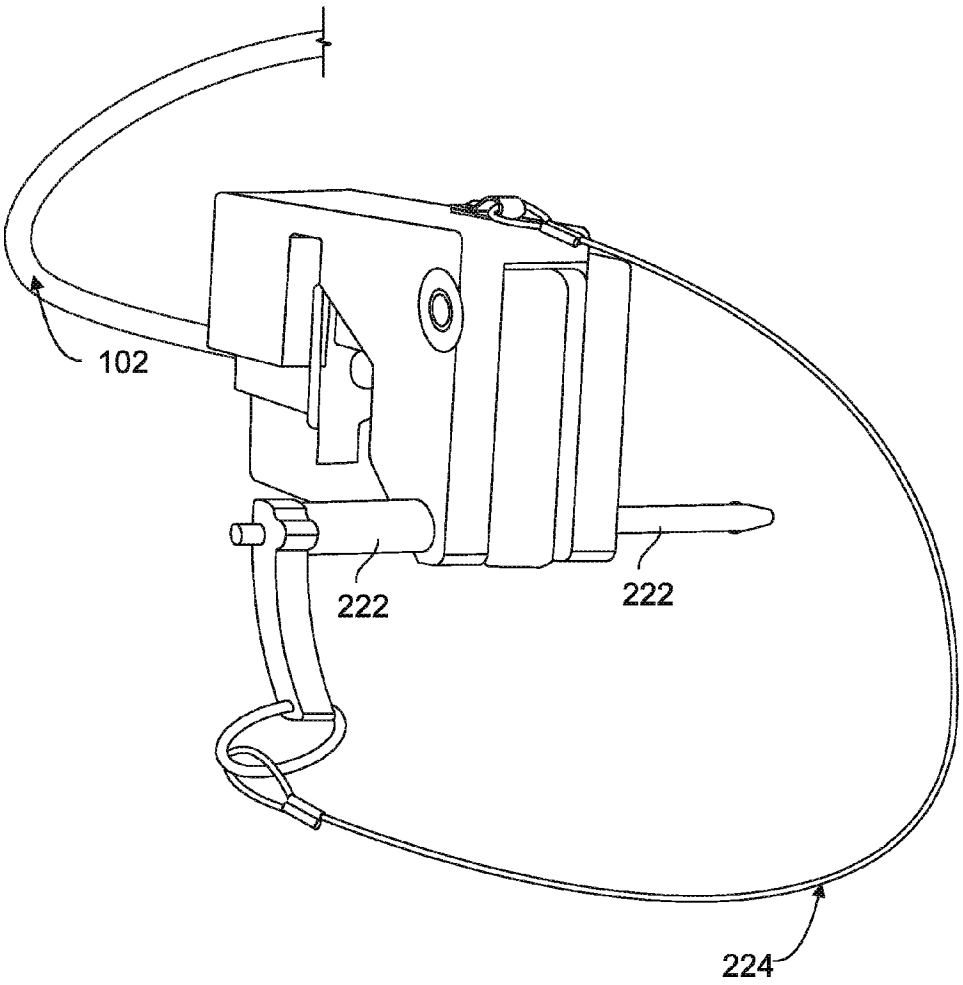
FIG. 2F illustrates retaining the latch element in the latched/closed position with respect to the main body, in accordance with an example implementation.

FIG. 2F illustrates retaining the latch element 204 in the latched/closed position with respect to the main body 202, in accordance with an example implementation. As depicted in FIG. 2F, a locking pin 222 is inserted through the aperture formed by alignment of the through-hole 220 with the holes 218A and 218B. The locking pin 222 precludes the latch element 204 from rotating back to an open or unlatched position when released by an operator, for example.

Further, in an example, the locking pin 222 may be connected to a first end of a cable 224. A second end of the cable 224 may be affixed to the main body 202 or the latch element 204. For instance, as shown in FIG. 2F, the second end of the cable 224 is affixed to a top surface of the main body 202; however, other locations for affixing the second end of the cable 224 are contemplated.

To remove the protective cover 200, the locking pin 222 may be removed, allowing the latch element 204 to rotate to the unlatched/open position, and the protective cover 200 may thus be pulled away from the switch 100. Access to the switch 100 is thus restored and the switch 100 can be activated.

The main body 202 and the latch element 204 could be made of different types of material based on an environment in which the protective cover 202 would be used. For instance, if the protective cover 202 is used in an aircraft-related environment, components of the protective cover 202 may be made of a fire retardant polymeric material that precludes scratching any other components of an aircraft. Material types could also be determined based on manufacturing techniques used to make the components. For instance, a material of a specific type may be used if the components are made using three-dimensional (3D) printing as opposed to machining or other manufacturing techniques.

As an example for illustration, the main body 202 and the latch element 204 could be made from a fire retardant nylon 11 laser sintering material, FR 106. In another example, ABS-M30, which is a production-grade thermoplastic material suitable for 3D printing, could be used. In still another example, ULTEM 9085, which is another thermoplastic material suitable for aerospace and automotive applications, could be used. These materials are examples for illustration only, and other materials are contemplated herein.

In the configuration shown in FIGS. 2A-2F, the main body 202 is positioned atop the switch 100, while the latch element 204 is positioned below the switch 100. Thus, the main body 202 may be referred to as an upper element of the protective cover 200, and the latch element 204 may be referred to as a lower or bottom element of the protective cover 200. However, other configurations and orientations are contemplated herein.

III. EXAMPLE METHODS

Figure 3:
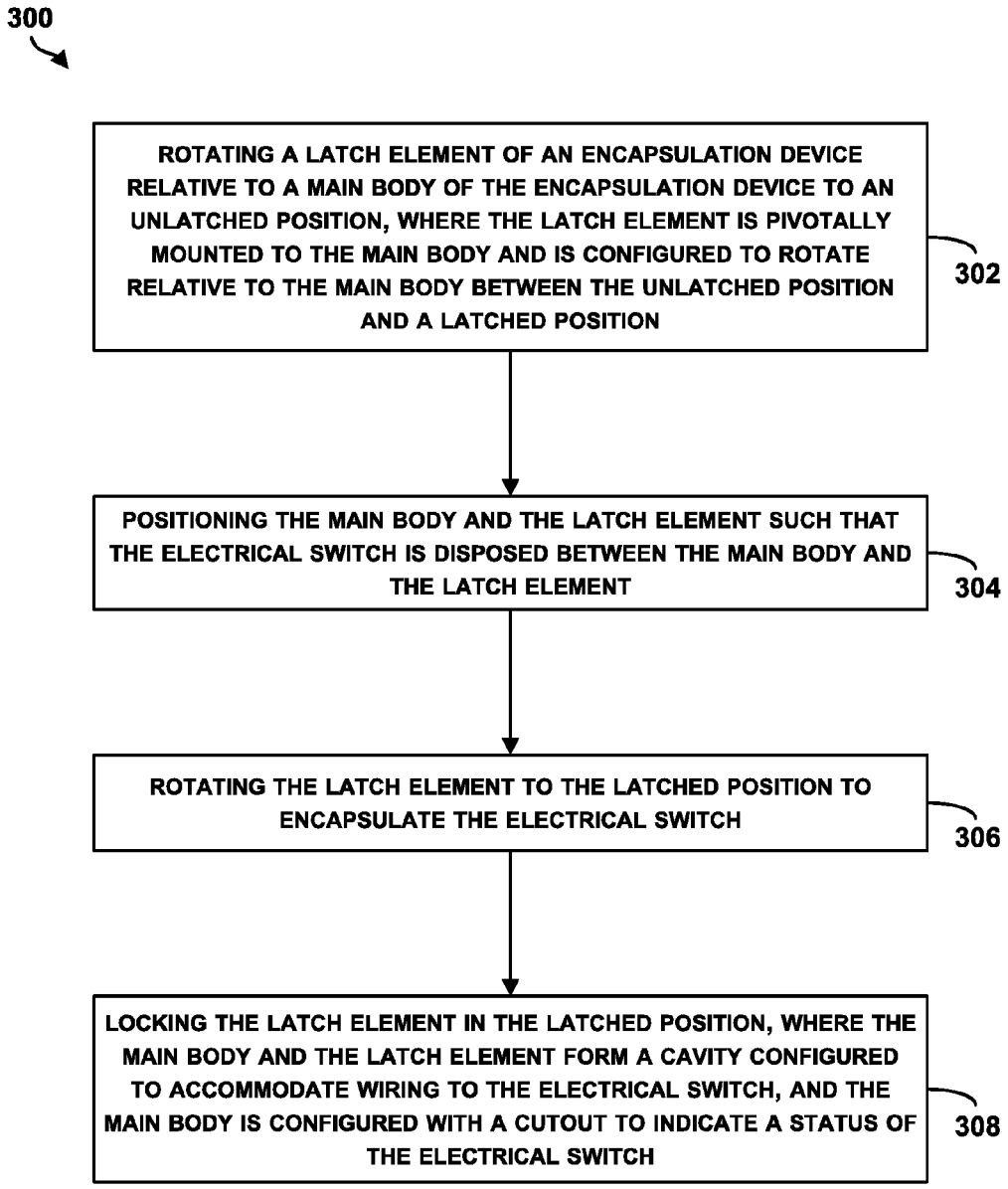
FIG. 3 is a flow chart of a method for preventing accidental operation of a switch, in accordance with an example implementation.

FIG. 3 is a flow chart of a method 300 for preventing accidental operation of a switch, in accordance with an example implementation. The method 300 may include one or more operations or actions as illustrated by one or more of blocks 302-308. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 302, the method 300 includes rotating a latch element of an encapsulation device relative to a main body of the encapsulation device to an unlatched position, where the latch element is pivotally mounted to the main body and is configured to rotate relative to the main body between the unlatched position and a latched position.

In line with the discussion related to FIGS. 1 and 2A-2F, a protective cover or encapsulation device, such as the protective cover 200, may have a main body (e.g., the main body 202) and a latch element (the latch element 204). In an example, the main body and the latch element may be made of a fire retardant polymeric material.

The encapsulation device may be configured to protect a switch against accidental operation. The latch element may be pivotally mounted by way of a pivot bolt, such as the pivot bolt 210, to the main body to enable rotation of the latch element relative to the main body. The latch element can thus pivot between an unlatched/open position and a latched/close position.

At block 304, the method 300 includes positioning the main body and the latch element such that the switch is disposed between the main body and the latch element. To encapsulate the switch, the latch element may be rotated to an unlatched/open position and the main body may be positioned or placed on top of the switch and pressed down to cover the switch from the top. At this position, the switch is disposed at least partially between the main body and the latch element. Positioning the encapsulation device in this manner would preclude activating the switch (e.g., flipping the switch) as described above with respect to the slanted portion 214 illustrated in FIG. 2B.

At block 306 of the method 300, the method includes rotating the latch element to the latched position to encapsulate the switch. The latch element may be rotated to a latched/closed position to encompass or encapsulate the switch. At his position, the switch is encapsulated by the encapsulation device and is precluded from being inadvertently activated.

At block 308 of the method 300 includes locking the latch element in the latched position, where the main body and the latch element form a cavity configured to accommodate wiring to the switch, and the main body is configured with a cutout to indicate a status of the switch. To retain the latch element in the latched/closed position, the latch element may be locked in place. As an example, a locking pin, such as the locking pin 222, may be inserted in an aperture formed by holes in the main body and corresponding hole(s) in the latch element. In this example, the locking pin may be configured to prevent rotation of the latch element and may thus lock the latch element in the latched position.

As mentioned herein, the main body and/or the latch element may have a cutout that have a size that precludes access to the switch so as to prevent accidental activation of the switch. However, the cutout is sufficiently large to indicate or reveal the status of the switch to an observer.

IV. CONCLUSION

It should be understood that arrangements described herein are for purposes of example only. As such, those skilled in the art will appreciate that other arrangements and other elements (e.g., machines, interfaces, orders, and groupings of operations, etc.) can be used instead, and some elements may be omitted altogether according to the desired results.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

What is claimed is:

1. A device for preventing operation of a switch, comprising:

a main body having a first end and a second end; and a latch element rotatably connected to the main body at the first end and is configured to move relative to the main body between an unlatched position and a latched position, wherein:

in the latched position, the main body and the latch element encapsulate the switch and form a cavity opposite the first end of the main body to accommodate wiring to the switch, and in the latched position, the main body is configured with a cutout extending along central portions of adjacent parallel surfaces to reveal a status of the switch.

2. The device of claim 1, wherein the cutout is of a size that precludes entry of an object that could cause accidental operation of the switch.

3. The device of claim 1, wherein the latch element is configured to move to the unlatched position such that the switch is disposed between the main body and the latch element prior to the latch element moving to the latched position to encapsulate the switch.

4. The device of claim 1, wherein the main body and the latch element have respective holes that align in the latched position to form an aperture for receiving a pin that locks the latch element in the latched position.

5. The device of claim 1, wherein the main body and the latch element are made of a fire retardant polymeric material.

6. The device of claim 1, wherein the latch element is rotatably connected to the main body by way of a pivot bolt, wherein the latch element is configured to pivot about the pivot bolt relative to the main body between the unlatched position and the latched position.

7. The device of claim 6, further comprising a spring mounted around the pivot bolt, wherein the spring is configured to exert a biasing force against the latch element to bias the latch element to the latched position.

8. A method for preventing operation of a switch, comprising:

rotating a latch element of an encapsulation device relative to a main body of the encapsulation device to a latched position to encapsulate the switch between the main body and the latch element in an off position;

wherein:

in the latched position, the main body and the latch element form a cavity opposite the first end of the main body to accommodate wiring to the switch, and in the latched position, the main body is configured with a cutout extending along central portions of adjacent parallel surfaces to reveal a status of the switch.

9. The method of claim 8, wherein the main body and the latch element have respective holes that align in the latched position to form an aperture, wherein locking the latch element in the latched position comprises:

inserting a pin through the aperture to lock the latch element in the latched position.

10. The method of claim 8, wherein the cutout is of a size that precludes access to the switch by an object that could cause accidental operation of the switch.

11. The method of claim 8, wherein the latch element is rotatably connected to the main body by way of a pivot bolt, wherein the latch element is configured to pivot about the pivot bolt relative to the main body between the unlatched position and the latched position.

12. The method of claim 8, wherein the main body and the latch element are made of a fire retardant polymeric material.

13. The method of claim 8, further comprising positioning the main body and the latch element such that the switch is disposed between the main body and the latch element in the closed position.

14. A device for preventing operation of a switch, comprising:

an upper element having a first end and a second end; and a lower element rotatably connected to the upper element at the first end by way of a pivot bolt, wherein:

in the closed position, the upper element and the lower element encapsulate the switch between the upper element and the lower element in an off position, in the closed position, the upper element and the lower element form a cavity opposite the first end of the upper element to accommodate wiring to the switch, and in the closed position, the upper element and the lower element form a cutout to reveal a status of the switch.

15. The device of claim 14, wherein the cutout is of a size that precludes access to the switch by an object that could cause accidental turning-on of the switch.

16. The device of claim 14, wherein the lower element is configured to move to an open position such that the switch is disposed between the upper element and the lower element prior to moving to the closed position to encapsulate the switch.

17. The device of claim 14, further comprising a spring mounted around the pivot bolt, wherein the spring is configured to exert a biasing force against the lower element to bias the lower element to the closed position.

18. The device of claim 14, wherein the upper element and the lower element are made of a fire retardant polymeric material.

19. The device of claim 14, wherein the upper element and the lower element have respective holes that align in the closed position to form an aperture for receiving a pin that locks the lower element in the closed position.

20. The device of claim 19, wherein the pin is connected to a first end of a cable, and wherein a second end of the cable is affixed to the upper element.

* * * * *